US006700087B2

(12) United States Patent
Rademacher et al.

(10) Patent No.: US 6,700,087 B2
(45) Date of Patent: Mar. 2, 2004

(54) ARC CHUTE ASSEMBLY

(75) Inventors: Loren L. Rademacher, Andover, MN (US); John E. Morley, Stacy, MN (US); Constantine Xykis, Eagan, MN (US)

(73) Assignee: Onan Corporation, Minneapolis, MN (US)

( * ) Notice: Subject to any disclaimer, the term of this patent is extended or adjusted under 35 U.S.C. 154(b) by 0 days.

(21) Appl. No.: 10/202,284

(22) Filed: Jul. 24, 2002

(65) Prior Publication Data

US 2004/0016722 A1 Jan. 29, 2004

(51) Int. Cl.[7] ..... H01H 33/02
(52) U.S. Cl. ..... 218/149; 218/150; 218/151
(58) Field of Search ..... 218/149, 148, 218/156, 157, 158, 151

(56) References Cited

U.S. PATENT DOCUMENTS

| | | | | | |
|---|---|---|---|---|---|
| 4,017,698 | A | | 4/1977 | Kuhn et al. | 200/50 AA |
| 4,107,497 | A | * | 8/1978 | Jencks et al. | 218/149 |
| 4,612,426 | A | * | 9/1986 | Maier et al. | 218/151 |
| 4,733,032 | A | * | 3/1988 | Pardini | 218/150 |
| 4,950,852 | A | * | 8/1990 | Goldman et al. | 218/150 |
| 4,970,482 | A | * | 11/1990 | Jacobs et al. | 218/38 |
| 5,247,142 | A | * | 9/1993 | Yonkovitz et al. | 218/150 |
| 5,285,180 | A | * | 2/1994 | Rezac et al. | 335/202 |
| 5,304,761 | A | | 4/1994 | Rosen et al. | 200/144 R |
| 5,341,191 | A | | 8/1994 | Crookston et al. | 335/16 |
| 5,898,152 | A | | 4/1999 | Kim | 218/149 |
| 6,031,438 | A | | 2/2000 | Runyan | 335/172 |
| 6,172,586 | B1 | | 1/2001 | Ferree et al. | 335/202 |
| 6,248,970 | B1 | | 6/2001 | DiMarco et al. | 218/149 |

* cited by examiner

*Primary Examiner*—Lincoln Donovan
*Assistant Examiner*—M. Fishman
(74) *Attorney, Agent, or Firm*—Schwegman, Lundberg, Woessner & Kluth, P.A.

(57) ABSTRACT

An arc chute including a first side wall having a plurality of holes, a second side wall having a plurality of holes and spaced apart from the first side wall, and a plurality of arc chute plates mounted between the first and second side walls. Each of the plurality of arc chute plates include a laterally extending tab on two sides of the arc chute plate, each of the laterally extending tabs being shaped to be interference fitted within one of the plurality of holes. The laterally extending tabs are dimensioned to not substantially extend beyond an outer surface of each of the side walls.

4 Claims, 4 Drawing Sheets

ARC CHUTE ASSEMBLY

FIELD OF THE INVENTION

This invention relates to the field of electrical switches, and more specifically to an arc chute for a switch.

BACKGROUND

Electrical switches such as circuit breakers and transfer switches typically include arc chutes located proximate the contacts of the switch to extinguish the arc that is produced when the switch is tripped and the contacts of the switch are rapidly opened. An arc chute typically includes a series of metallic plates that are configured in a spaced apart relationship and held in place by dielectric side panels. When the contacts of the switch are opened, the resulting arc is driven to the metallic plates of the arc chute where the arc is then extinguished by the plates. Typically, the metallic plates are held in place by tabs on the plates which extend through holes in the side panels so that the tabs can be either staked in place or fastened by external fasteners. Such an assembly process is time consuming and the resulting arc chute structure can be bulky requiring a relatively large mounting area within the switch.

SUMMARY

The present invention provides an arc chute having features to allow for easy manufacture and assembly of the arc chute and allow for an improved switch incorporating the arc chute. In one aspect, an arc chute includes a first side wall having a plurality of holes, a second side wall having a plurality of holes and spaced apart from the first side wall, and a plurality of arc chute plates mounted between the first and second side walls. Each of the plurality of arc chute plates include one or more laterally extending tabs extending from the sides of each plate. Each of the laterally extending tabs are shaped to be interference fitted within one of the plurality of holes. Each of the laterally extending tabs are dimensioned to not substantially extend beyond an outer surface of each of the side walls.

Another aspect includes a method of manufacturing an arc chute. In one embodiment, a method for assembling an arc chute includes interference fitting one or more tabs on a first side of an arc chute plate into a hole on a first arc chute side wall, and interference fitting one or more tabs on a second side of the arc chute plate into a hole on a second arc chute side wall.

Another aspect provides a switch. In one embodiment, a switch includes a case having an arc chute mounting area having a ridge near a back portion of the arc chute mounting area. An arc chute is mounted within the arc chute mounting area. The arc chute includes a pair of side walls and a plurality of arc chute plates mounted between the pair of side walls, wherein each of the pair of side walls includes a movable tab which is removably engageable with the ridge.

Among other advantages, one or more embodiments of the present system provide an arc chute which is easily manufactured, has a relatively small design, and is easily removable from a switch.

DETAILED DESCRIPTION

In the following detailed description, reference is made to the accompanying drawings which form a part hereof, and in which is shown by way of illustration specific embodiments in which the invention may be practiced. These embodiments are described in sufficient detail to enable those skilled in the art to practice the invention, and it is to be understood that other embodiments may be utilized and that structural changes may be made without departing from the scope of the present invention. Therefore, the following detailed description is not to be taken in a limiting sense, and the scope of the present invention is defined by the appended claims and their equivalents.

Figure 1:
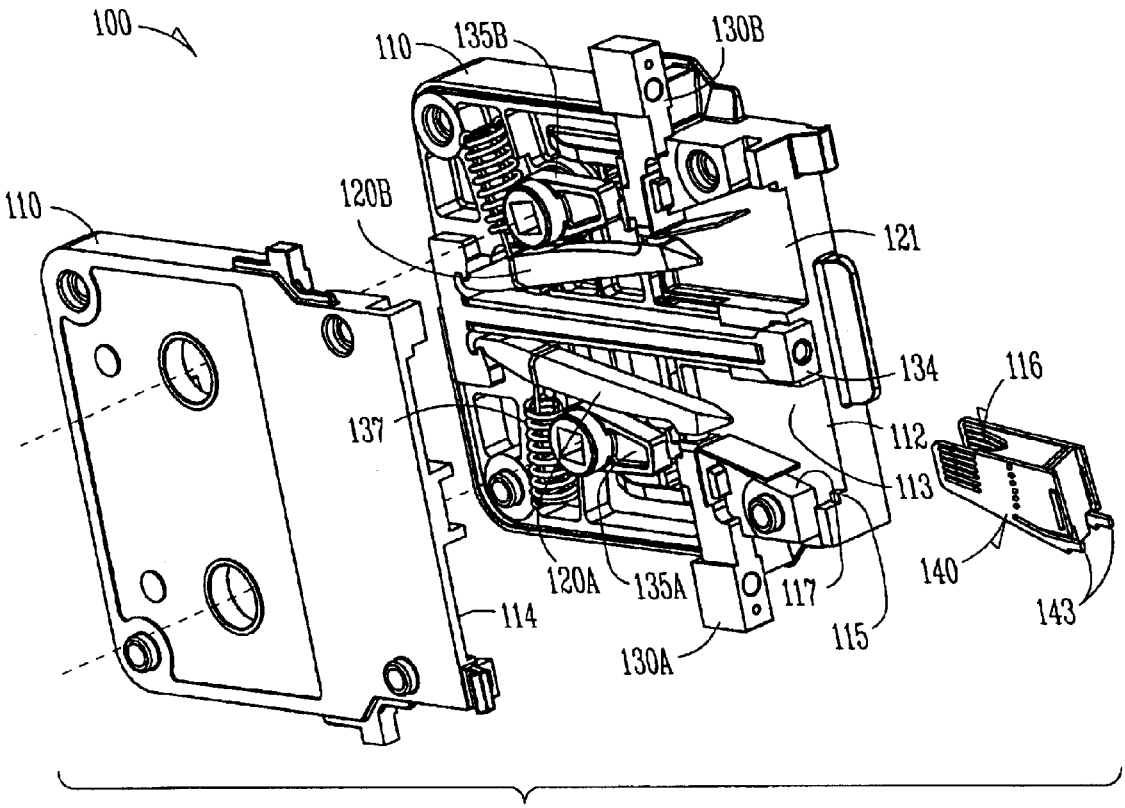
FIG. 1 shows an exploded view of a transfer switch having an arc chute according to one embodiment of the present invention.

FIG. 1 shows a portion of a transfer switch 100 according to one embodiment. The portion of transfer switch 100 shown is understood to be one out of many possible such portions. For instance a three-phase transfer switch can include three back to back members similar to the portion shown in FIG. 1. Other circuit breakers and switches using arc chutes can be configured using the teachings of the present system and are considered within the scope of the present discussion.

In one example, transfer switch 100 is used for switching between a utility and a generator for feeding an electrical load. Current ranging from 30 Amps to 300 Amps can flow through an example transfer switch. Transfer switch 100 generally includes a case 110, a pair of movable contacts 120A and 120B, a pair of stationary input contacts 130A and 130B, and one or more arc chutes 140. Only one arc chute 140 is shown in FIG. 1. However, two are usually provided with one mounted in a lower mounting area 112 and one in an upper mounting area 121.

Case 110 is a molded two-part case having various features for holding members of the transfer switch. Movable contacts 120A and 120B are rotatably coupled within case 110 to strike or contact stationary contacts 130A and 130B, respectively, when closed. Each of the moveable contacts 120A and 120B is connected to an output contact 134.

Movable contact 120A is adapted to be intermittently connected to a corresponding primary input contact 130A, while movable contact 120B is adapted to be intermittently connected to corresponding secondary input contact 130B.

Cams 135A and 135B are mounted to maneuver the movable contacts 120A and 120B into, and out of, engagement with their respective input contacts 130A and 130B. As the cams 135A and 135B rotate, the tips on the cams eventually begin to engage the movable contacts 120A and 120B to force the contacts away from their respective input contacts 130A and 130B. Conversely, once the tips of the cams rotate in the opposite direction past the movable contacts 120A and 120B, a spring 137 forces each movable contact into engagement with their respective stationary input contact.

In one use of switch 100, for example, movable contact 120B is engaged with the primary input contacts 130B when power is being supplied from a primary power source, such as a utility. When there is an interruption in the primary power supply, cam 135B rotates to disengage the movable contact 120B from the primary input contacts 130B, and cam 135A rotates to allow movable contact 120A to engage the secondary input contacts 130A so that power can be supplied from a secondary power source, such as a generator. Other features of transfer switch 100 are described in co-pending and co-assigned U.S. patent application Ser. No. 10/202,260, filed Jul. 24, 2002, which is incorporated herein by reference in its entirety.

Figure 6:
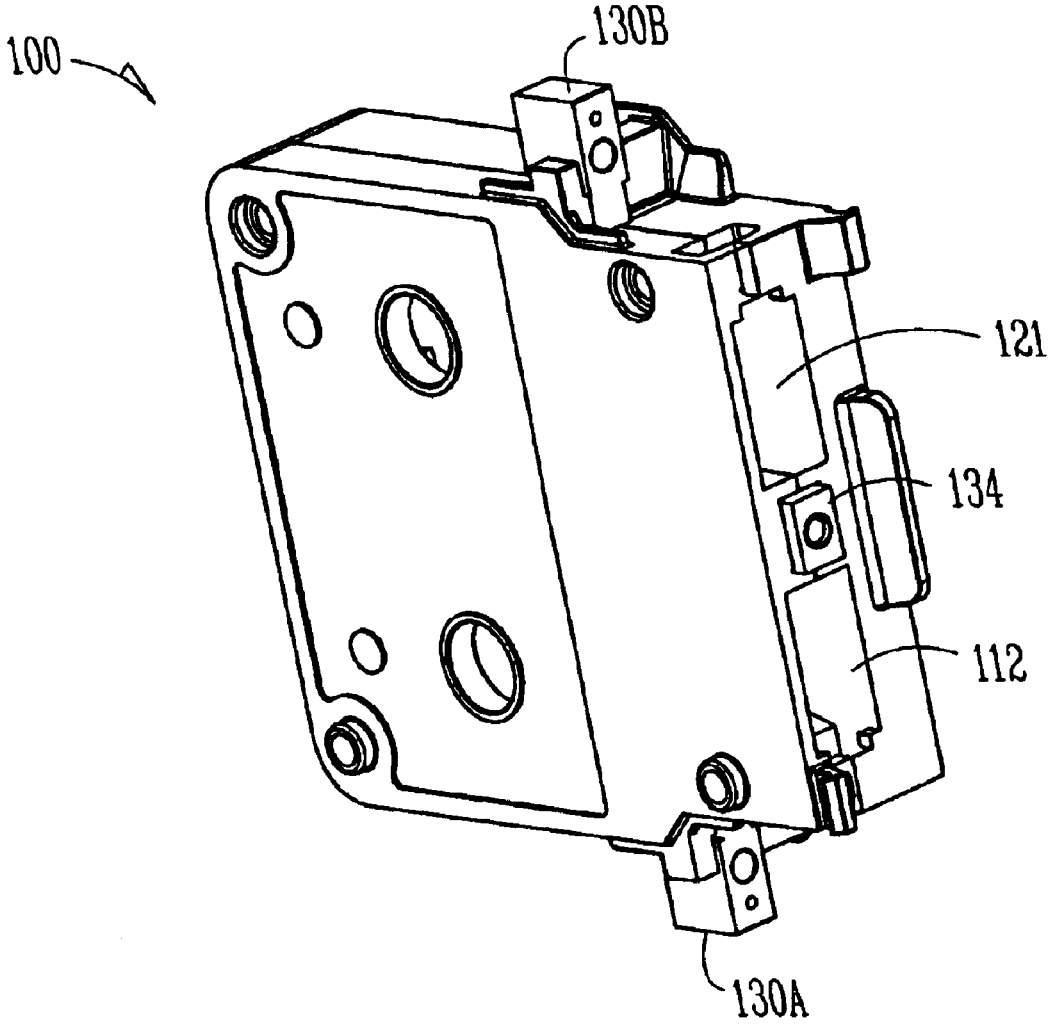
FIG. 6 shows a perspective view of the transfer switch of FIG. 1.

Case 110 includes arc chute mounting areas 112 and 121. Arc chute mounting areas 112 and 121 are shaped to match the profile shape of arc chutes(s) 140. In this example, arc chute mounting area 112 includes a pair of flat, parallel side walls 113 and 114 and a sloping lower surface 117. Near the outer portion of arc chute mounting are 112 is a ridge 115. Ridge 115 is a slightly raised section which is designed for retaining arc chute 140 within the arc chute mounting area. Arc chute 140 includes a pair of movable tabs 143 which engages ridges 115 when the arc chute is mounted within switch 100. A used can squeeze tabs 143 together to remove arc chute 140 from arc chute mounting area 112 without the need for tools and without removing any fasteners. This allows contacts 120A, 120B, 130A, and 130B to be visually inspected if necessary without having to disassemble portions of the switch. For example, FIG. 6 shows switch 100 with mounting areas 112 and 121 without any arc chutes mounted therein.

Referring again to FIG. 1, arc chute 140 can be located within arc chute mounting area 112 such that movable contact 120A goes through U-shaped open area 116 of arc chute 140 when the movable contact 120A is rotated open. When contacts 120A or 120B are opened, the resulting arc is driven to one or more metallic plates 148 of the arc chute where the arc is extinguished by the plates.

Figure 2:
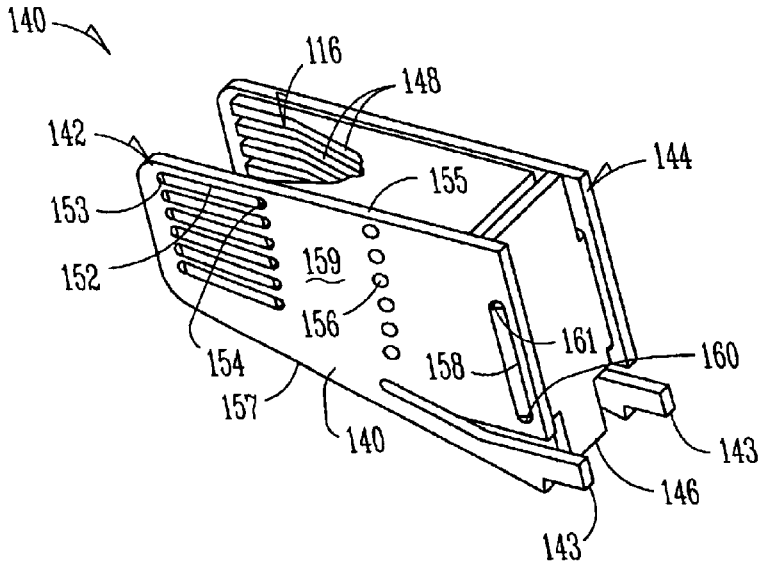
FIG. 2 shows further details of the arc chute of FIG. 1.

FIG. 2 shows a bottom isometric view showing further details of arc chute 140 according to one embodiment. Arc chute 140 includes a first side wall 142, a second side wall 144, a back wall 146, and the plurality of arc chute plates 148.

First side wall 142 and second side wall 144 are similar and only first side wall 142 will be described in detail. First side wall 142 includes a first series of mounting holes 152. Mounting holes 152 are located near the front of the side wall. In one example, each mounting hole 152 includes an elongated slot having a first rounded profile end 153 and a second rounded profile end 154. First side wall 142 also includes a second series of mounting holes 156. Mounting holes 156 run generally downward from an upper portion 155 of the side wall to a lower portion 157. In this example, each of mounting holes 156 is circular, presenting a substantially round profile. Other embodiments provide an oval hole, an elliptical hole, or other equivalent shape. Each side wall also includes a back plate mounting hole 158. Back plate mounting hole 158 is a vertically oriented slot running from the upper to the lower portion of the side wall. Hole 158 includes a first round profile end 160 and a second round profile end 161.

Each of arc chute plates 148 is a flat, U-shaped member formed of an electrically conductive material, typically metal. The U-shaped area of each arc chute plate 148 defines open area 116 for contact 120 to move through (See FIG. 1).

Figure 3:
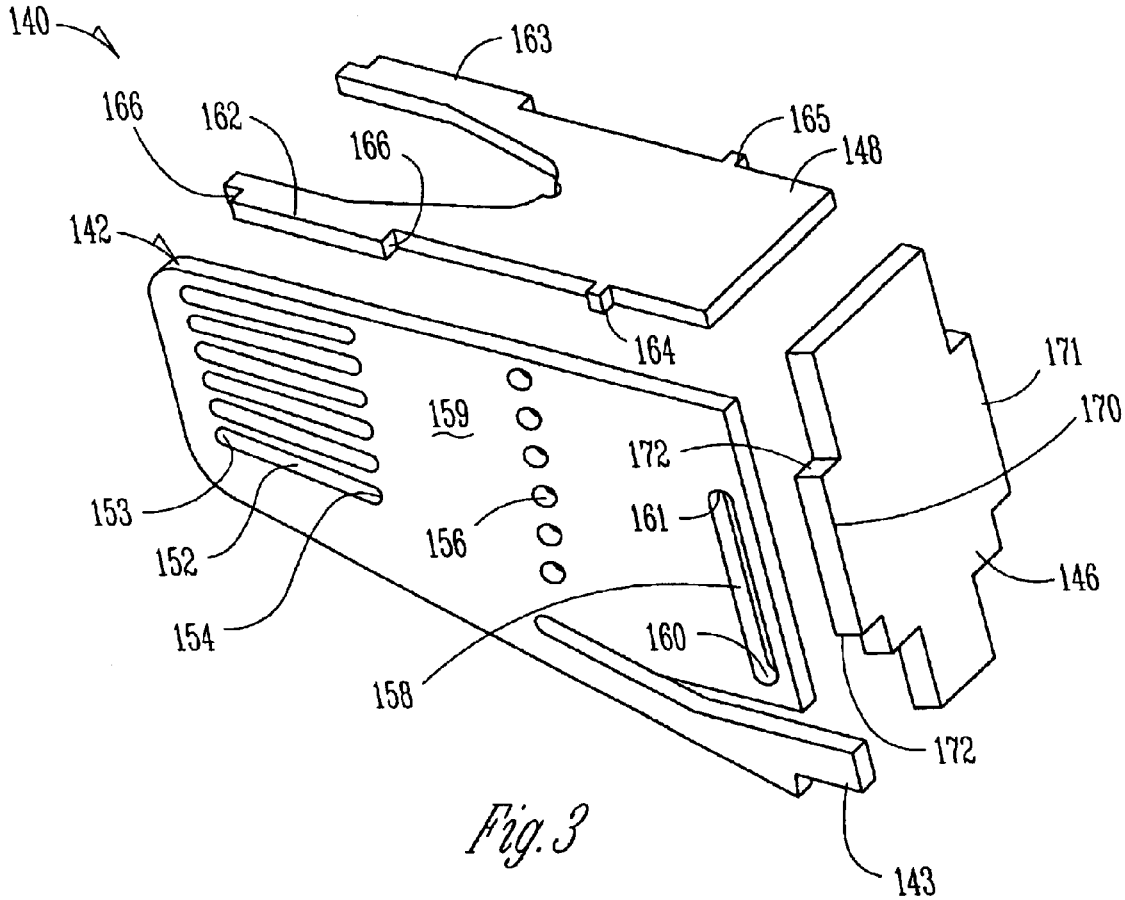
FIG. 3 shows an exploded view of portions of the arc chute of FIG. 1.

FIG. 3 shows an exploded view of arc chute 140. Extending laterally from each side of each arc chute plate 148 are one or more tabs. In this example, each plate 148 includes four laterally extending tabs 162–165. Front tabs 162 and 163 have a rectangular cross-section defining a square-edged profile having squared edges 166. Front tabs 162 and 163 are dimensioned to interference fit within mounting holes 152 of the arc chute side walls. Tabs 162 and 163 arc sized so that the square edges 166 of the tabs deform the round edge ends 153 and 154 of mounting holes 152 when the tabs are pressed within the holes. This provides a tight interference fit which holds the arc chute assembly together without any extraneous hardware and without any extra staking or fastening steps to the manufacturing process. In one embodiment, mounting holes 152 and laterally extending tabs 162 and 163 have similar cross-sectional or profile shapes with the tabs being slightly larger than the holes and thus allowing for an interference or friction fit mounting.

In one example, back tabs 164 and 165 also have a rectangular square edge profile. Thus, in a similar manner as described above for tabs 162 and 163, tabs 164 and 165 fit within and deform the edges of mounting holes 156 when the tabs are pressed into the mounting holes. Again, in some embodiments mounting holes 156 and laterally extending tabs 164 and 165 have similar cross-sectional or profile shapes with the tabs being slightly larger than the holes, thus allowing for an interference or friction fit mounting. In a likewise manner, each of a plurality of arc chute plates 148 are mounted between first and second side walls 142 and 144.

In one example, each of first side wall 142 and second side wall 144 include an electrically non-conductive material which is softer than the material of the arc chute plates 148. Example materials include vulcanized paper or glass fiber reinforced polyester. This provides that mounting holes 152 and 156 plastically deform when tabs 162–165 are pressed into the mounting holes. This allows for a tight interference fit when the tabs are pressed within the mounting holes.

Back wall 146 is a non-metallic planar structure and includes laterally extending tabs 170 and 171 which interference fit within mounting holes 158 in a manner similar to that described above for tabs 162–165 of arc chute plate 148. Tabs 170 and 171 have squared ends 172 which deform the round profile ends 159 and 160 of mounting hole 158 when the tabs are pressed into the mounting holes. Back wall 146 is shaped and located relative to plates 148 to direct the flow of outwardly expanding gasses produced by an arc. Some embodiments omit back wall 146.

Figure 4:
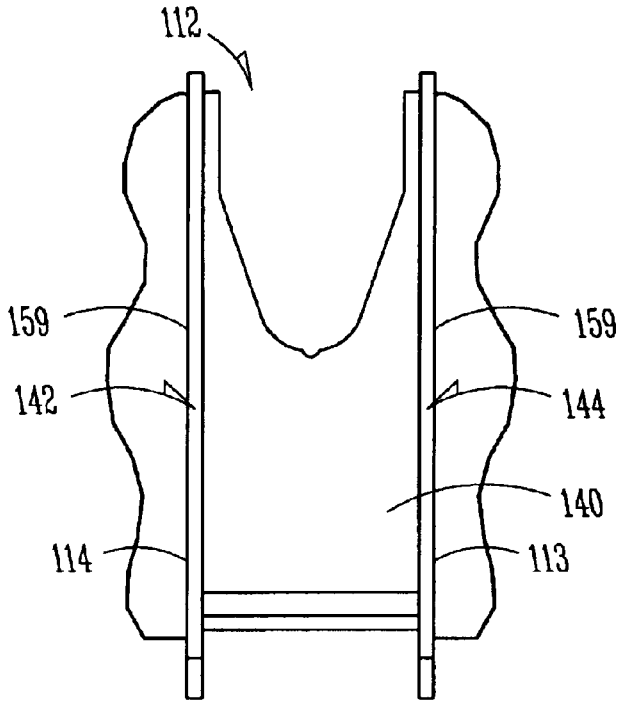
FIG. 4 shows a top view of the arc chute mounted within the transfer switch of FIG. 1.

FIG. 4 shows a top view of arc chute 140 within arc chute mounting area 112. Each of side walls 142 and 144 is flushly mounted against walls 113 and 114 of arc chute mounting area 112. Referring again to FIGS. 2 and 3, it is seen that laterally extending tabs 162–165 and 171, 172 are dimensioned to not extend beyond an outer surface 159 of each of the side walls 142 and 144. This allows arc chute 140 to be flushly and tightly fitted within arc chute mounting area 112 such that the outer surface of the side walls 142 and 144 flushly contact walls 113 and 114 of arc chute mounting area. This configuration allows for a saving of space within switch 100 since the tabs of each arc chute plate do not extend substantially past the outer surfaces, so no room within the switch is needed to accommodate the tabs. Furthermore, this configuration allows the side walls 113 and 114 of the arc chute mounting area to help hold the arc chute 140 together since the arc chute mounting area walls 113 and 114 are in direct contact with the arc chute walls 142 and 144.

Figure 5:
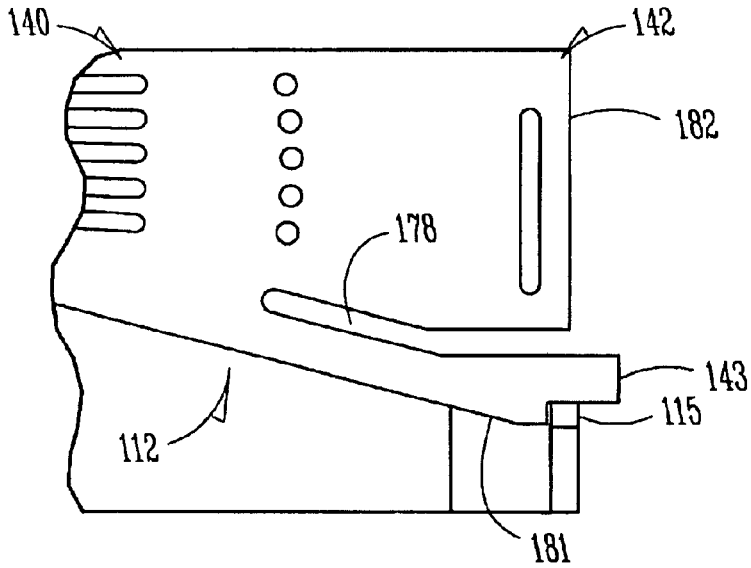
FIG. 5 shows a side view of the arc chute mounted within the transfer switch of FIG. 1.

FIG. 5 shows a side view of arc chute 140 within arc chute mounting area 112. Tabs 143 have a lip or extension portion

181 which contacts ridges 115 to hold the arc chute within the switch. Tabs 143 extend beyond an outer end 182 of the main body portion of the arc chute so as to be easily accessible. A cut-out 178 running along side wall 142 of arc chute 140 defines tab 143 and provides for lateral movement of the tab. In one example, tabs 143 are squeezed together so bottom lip 181 of each tab 143 moves beyond the highest portion of ridge 115 (See FIG. 1). This allows the arc chute to loosen from arc chute mounting area 112 and provides easy removal of the arc chute to inspect the contacts 120 and 130 without disassembling the whole switch.

In one example use of the present system, an arc chute is assembled by interference fitting one or more tabs 162–165 on a first side of an arc chute plate 148 into a mounting hole 152 and/or 156 on a first arc chute side wall 142, and interference fitting one or more tabs on a second side of the arc chute plate into a second arc chute side wall 144. The completed arc chute 140 can then be mounted with an arc chute mounting portions 112 and/or 121 of a switch 100 as shown in FIGS. 1, 4, 5, and 6.

The present arc chute structure and assembly technique requires fewer steps and hardware than a typical arc chute which requires a staking process to hold the arc chute plates in place. Moreover, a switch holding a typical arc chute needs to have space provided to hold the outwardly extending tabs. The arc chute plate tabs of the present invention do not extend beyond the outer surface of the arc chute side walls so the overall size of the switch can be smaller since the arc chute mounting area walls are flush against the arc chute.

It is understood that the above description is intended to be illustrative, and not restrictive. Many other embodiments will be apparent to those of skill in the art upon reviewing the above description. The scope of the invention should, therefore, be determined with reference to the appended claims, along with the full scope of equivalents to which such claims are entitled.

What is claimed is:

1. A switch comprising:

a case having an arc chute mounting area having a ridge near a back portion of the arc chute mounting area;

a pair of electrical contacts within the case; and an arc chute located proximate the pair of electrical contacts and mounted within the arc chute mounting area, the arc chute including a pair of side walls and a plurality of arc chute plates mounted between the pair of side walls, wherein each of the pair of side walls includes a movable tab which is removably engageable with the ridge, wherein when the movable tab is moved the arc chute is removable from the arc chute mounting area.

2. The switch of claim 1, wherein the arc chute mounting area includes a pair of flat walls spaced apart from each other, wherein each of the pair of side walls of the arc chute is flushly mounted against one of the pair of flat walls of the arc chute mounting area.

3. The switch of claim 1, wherein each of the pair of side walls of the arc chute includes a plurality of holes and each of the arc chute plates include a laterally extending tab on each side of the arc chute plate, wherein each of the tabs is positioned within one of the plurality of holes such that the laterally extending tabs do not extend beyond an outer surface of each of the side walls.

4. The switch of claim 3, wherein each of the tabs is interference fitted within each of the holes.

* * * * *